US011127342B2

(12) United States Patent
Feng et al.

(10) Patent No.: US 11,127,342 B2
(45) Date of Patent: Sep. 21, 2021

(54) PIXEL CIRCUIT FOR DRIVING LIGHT EMITTING DIODE TO EMIT LIGHT AND METHOD OF CONTROLLING THE PIXEL CIRCUIT

(71) Applicants: BOE TECHNOLOGY GROUP CO., LTD., Beijing (CN); ORDOS YUANSHENG OPTOELECTRONICS CO., LTD., Inner Mongolia (CN)

(72) Inventors: Yu Feng, Beijing (CN); Libin Liu, Beijing (CN)

(73) Assignees: BOE TECHNOLOGY GROUP CO., LTD., Beijing (CN); ORDOS YUANSHENG OPTOELECTRONICS CO., LTD., Ordos Inner Mongolia (CN)

( * ) Notice: Subject to any disclaimer, the term of this patent is extended or adjusted under 35 U.S.C. 154(b) by 344 days.

(21) Appl. No.: 16/096,102

(22) PCT Filed: Jan. 15, 2018

(86) PCT No.: PCT/CN2018/072598
§ 371 (c)(1),
(2) Date: Oct. 24, 2018

(87) PCT Pub. No.: WO2018/214533
PCT Pub. Date: Nov. 29, 2018

(65) Prior Publication Data

US 2021/0035490 A1 Feb. 4, 2021

(30) Foreign Application Priority Data

May 26, 2017 (CN) ..... 201710382557.X

(51) Int. Cl.
*G09G 3/3233* (2016.01)
*G09G 3/32* (2016.01)
*G09G 3/20* (2006.01)

(52) U.S. Cl.
CPC ..... *G09G 3/32* (2013.01); *G09G 3/2092* (2013.01); *G09G 2310/0272* (2013.01); *G09G 2310/08* (2013.01); *G09G 2320/066* (2013.01)

(58) Field of Classification Search
CPC ... G09G 2300/0819; G09G 2300/0842; G09G 2300/0861; G09G 2300/0866;
(Continued)

(56) References Cited

U.S. PATENT DOCUMENTS 8,378,933 B2 * 2/2013 Kwak ..... G09G 3/3233 345/76
2009/0201230 A1 * 8/2009 Smith ..... G09G 3/3283 345/76
(Continued)

FOREIGN PATENT DOCUMENTS

CN 101075410 A 11/2007
CN 103778883 A 5/2014
(Continued)

OTHER PUBLICATIONS

First Office Action for CN Appl. No. 201710382557.X, dated May 3, 2018.
(Continued)

*Primary Examiner* — Ram A Mistry
(74) *Attorney, Agent, or Firm* — Dinsmore & Shohl LLP

(57) ABSTRACT

The present disclosure provides a display device, a pixel circuit and its control method, the circuit including: a resetting and charging circuit, for resetting a capacitor
(Continued)

connected between a gate electrode of the driving transistor of the pixel circuit and an anode of a LED, and then charging the capacitor; a writing circuit, for writing a data signal to the gate electrode of the driving transistor; a driving circuit including the driving transistor, for driving the LED to emit light when the driving transistor receives the data signal; wherein, the driving transistor for driving the LED to emit light is an oxide TFT, and the other transistors in the pixel circuit are low temperature polysilicon (LTPS) TFTs.

12 Claims, 8 Drawing Sheets

(58) Field of Classification Search
CPC ... G09G 2310/0218; G09G 2310/0251; G09G 2310/0256; G09G 2320/0238; G09G 3/3233; G09G 2310/027; G09G 3/3291
See application file for complete search history.

(56) References Cited

U.S. PATENT DOCUMENTS

| | | | | |
|---|---|---|---|---|
| 2016/0210906 | A1 | 7/2016 | In et al. | |
| 2018/0204510 | A1* | 7/2018 | Chung | G09G 3/3233 |

FOREIGN PATENT DOCUMENTS

| | | | |
|---|---|---|---|
| CN | 104464624 | A | 3/2015 |
| CN | 105612620 | A | 5/2016 |
| CN | 205541822 | U | 8/2016 |
| CN | 106024838 | A | 10/2016 |
| CN | 106952618 | A | 7/2017 |

OTHER PUBLICATIONS

International Search Report and Written Opinion for International Appl. No. PCT/CN2018/072598, dated Apr. 12, 2018.
Second Office Action for CN Appl. No. 201710382557.X, dated Nov. 16, 2018.

* cited by examiner

PIXEL CIRCUIT FOR DRIVING LIGHT EMITTING DIODE TO EMIT LIGHT AND METHOD OF CONTROLLING THE PIXEL CIRCUIT

CROSS REFERENCE TO RELATED APPLICATIONS

This application is a national stage of International Application No. PCT/CN2018/072598, filed on Jan. 15, 2018, which claims priority to Chinese Patent Application No. 201710382557.X, filed on May 26, 2017. Both of the aforementioned applications are hereby incorporated by reference in their entireties.

FIELD

The present disclosure relates to the field of liquid crystal display technology, and in particular to a display device, a pixel circuit and a method of controlling the pixel circuit.

BACKGROUND

Among various types of flat panel display devices, active matrix organic light emitting display devices (AMOLED) use self-illuminating organic light emitting diodes (OLED) to display images, and generally have advantageous characteristics such as short response time, driven with lower power consumption, better brightness and color purity. Thus organic light emitting display devices have become the focus of next-generation display devices.

For a large active matrix organic light emitting display device, a plurality of pixels located at intersections of scan lines and data lines are included. Each of the pixels includes an organic light emitting diode and a pixel circuit for driving the organic light emitting diode. The pixel circuit typically includes a switching transistor, a driving transistor, and a storage capacitor.

SUMMARY

According to an embodiment of the present disclosure, a pixel circuit for driving a light emitting diode (LED) to emit light is provided, including:

a resetting and charging circuit, for resetting a capacitor connected between a gate electrode of the driving transistor of the pixel circuit and an anode of the LED, and then charging the capacitor;

a writing circuit, for writing a data signal to the gate electrode of the driving transistor;

a driving circuit including the driving transistor, for driving the LED to emit light when the driving transistor receives the data signal;

wherein, the driving transistor for driving the LED to emit light is an oxide TFT, and other transistors in the pixel circuit are low temperature polysilicon (LTPS) TFTs.

Preferably, the driving circuit particularly includes: an input terminal of a light emitting indication signal, and the capacitor, a driving transistor T3 and a transistor T4 connected in series between a device operating voltage VDD and the anode of the LED;

wherein, the gate electrode of the transistor T4 is connected to the input terminal of the light emitting indication signal, and the gate electrode of the transistor T3 is used to receive a data signal sent by the writing circuit.

Further, the driving circuit further includes a capacitor connected between the device operating voltage VDD and the anode of the LED.

Preferably, the writing circuit particularly includes: an input terminal of a third timing signal, an input terminal of a data signal, and a transistor T2;

wherein, the gate electrode of the transistor T2 is connected to the input terminal of the third timing signal, and the source electrode and the drain electrode of the transistor T2 are connected in series between the input terminal of the data signal and the gate electrode of the driving transistor.

Preferably, the resetting and charging circuit particularly includes: input terminals of the first and second timing signals, a transistor T1, a transistor T5, and a transistor T6;

wherein, the gate electrode of the transistor T5 is connected to the input terminal of the second timing signal, and the source and the drain electrodes of the transistor T5 are connected in series between a reference voltage and the gate electrode of the transistor T3; the source and drain electrodes of the transistor T1 and the source and drain electrodes of the transistor T6 are connected in series between the reference voltage and the anode of the LED; the gate electrodes of the transistor T1 and the transistor T6 are both connected to an input terminal of the first timing signal, and a connection point of the transistor T5 and the transistor T6 is connected to the gate electrode of the transistor T3.

Alternatively, the resetting and charging circuit specifically includes: input terminals of the first and second timing signals, a transistor T205 and a transistor T201;

wherein, the source and drain electrodes of the transistor T205 and the source and drain electrodes of the transistor T201 are connected in series between the reference voltage and the anode of the LED; the gates of the transistor T201 and the transistor T205 are respectively connected to the input terminals of the first and second timing signals, the connection point of the transistor T205 and the transistor T201 is connected to the gate electrode of the transistor T3.

The present disclosure further provides a method of controlling a pixel circuit, including:

controlling a resetting and charging circuit of the pixel circuit to reset a capacitor connected between the anode of a LED and a gate electrode of a driving transistor of the pixel circuit during a first period of time;

controlling the resetting and charging circuit to charge the capacitor during a second period of time;

controlling a writing circuit of the pixel circuit to write a data signal to the gate electrode of the driving transistor during a third period of time;

controlling a driving circuit of the pixel circuit to drive the LED to emit light with a driving transistor during a fourth period of time;

wherein, the driving transistor is an oxide TFT in the pixel and configured to drive the LED to emit light, and other transistors in the pixel circuit are all LTPS TFTs.

Preferably, controlling a driving circuit of the pixel circuit to drive the LED to emit light with a driving transistor during a fourth period of time particularly includes:

controlling to output an active signal of the light emitting indication signal during the fourth period of time, so that the driving circuit drives the LED to emit light with the driving transistor according to the active signal of the light emitting indication signal;

wherein, the driving circuit specifically includes: the capacitor, and the driving transistor T3 and the transistor T4 connected in series between the device operating voltage VDD and the anode of the LED;

wherein, the gate electrode of the transistor T4 is connected to an input terminal of the light emitting indication signal, and the gate electrode of the transistor T3 is used to receive a data signal sent by the writing circuit.

Preferably, controlling a writing circuit of the pixel circuit to write a data signal to the gate electrode of the driving transistor during a third period of time particularly includes:

controlling to output active signals of third timing signal and data signal during the third period of time, so that the writing circuit writes the active signal of the data signal to the gate electrode of the driving transistor according to the active signal of the third timing signal, wherein:

the writing circuit particularly includes: a transistor T2, wherein, the gate electrode of the transistor T2 is connected to the input terminal of the third timing signal, and the source and drain electrodes of the transistor T2 are connected in series between the input terminal of the data signal and the gate electrode of the driving transistor.

Preferably, controlling the resetting and charging circuit of the pixel circuit to reset a capacitor connected between the anode of a LED and a gate electrode of a driving transistor of the pixel circuit during a first period of time, and controlling the resetting and charging circuit to charge the capacitor during a second period of time particularly includes:

controlling to output an active signal of the first timing signal during the first period of time, so that the resetting and charging circuit resets the capacitor according to the active signal of the first timing signal;

controlling to output an active signal of the second timing signal during the second period of time, so that the resetting and charging circuit charges the capacitor according to the active signal second timing signal; wherein:

the resetting and charging circuit particularly includes: a transistor T1, a transistor T5 and a transistor T6;

wherein, the gate electrode of the transistor T5 is connected to the input terminal of the second timing signal, and the source and the drain electrodes of the transistor T5 are connected in series between an input terminal of a reference voltage and the gate electrode of the transistor T3; the source and drain electrodes of the transistor T1 and the source and drain electrodes of the transistor T6 are connected in series between the input terminal of the reference voltage and the anode of the LED; the gate electrodes of the transistor T1 and the transistor T6 are both connected to an input terminal of the first timing signal, and a connection point of the transistor T5 and the transistor T6 is connected to the gate electrode of the transistor T3.

Alternatively, controlling the resetting and charging circuit of the pixel circuit to reset a capacitor connected between the anode of a LED and a gate electrode of a driving transistor of the pixel circuit during a first period of time, and controlling the resetting and charging circuit to charge the capacitor during a second period of time particularly includes:

outputting active signals of first and second timing signals during the first period of time, so that the resetting and charging circuit resets the capacitor according to the active signals of the first and second timing signals;

continuing providing the active signal of the second timing signal during the second period of time, so that the resetting and charging circuit charges the capacitor according to the active signal of the second timing signal; wherein:

the resetting and charging circuit particularly includes: a transistor T205 and a transistor T201;

wherein, the source and drain electrodes of the transistor T205 and the source and drain electrodes of the transistor T201 are connected in series between the input terminal of the reference voltage and the anode of the LED; the gates of the transistor T201 and the transistor T205 are respectively connected to the input terminals of the first and second timing signals, the connection point of the transistor T205 and the transistor T201 is connected to the gate electrode of the transistor T3.

The present disclosure also provides a display device including the above-described pixel circuit.

DETAILED DESCRIPTION OF PREFERRED EMBODIMENTS

Figure 1:
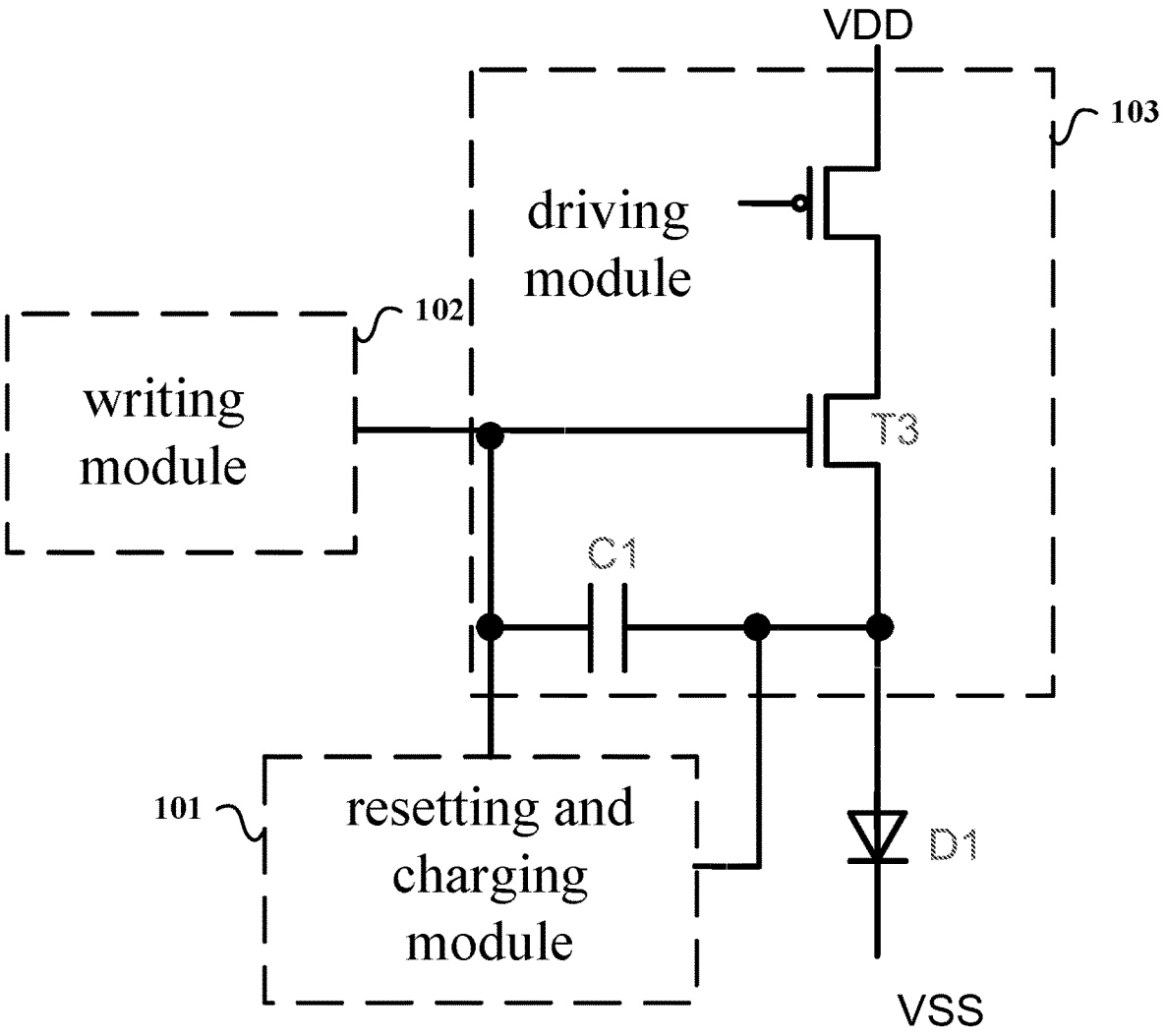
FIG. 1 is a block diagram showing the principle of a pixel circuit according to an embodiment of the present disclosure.

For a clear understanding of the object, the technical solution and advantages of the present disclosure, the present disclosure will be further described in detail below in conjunction with the accompanying drawings and embodiments.

A detailed description of embodiments of the present invention will be given below. Illustrative embodiments are shown in the drawings, in which the similar reference signs are used throughout to represent the same or similar elements or elements having the same or similar functions. The embodiments described with reference to the drawings are illustrative, which are merely used to interpret the present disclosure, but cannot be understood as limitation to the present disclosure.

Those skilled in the art will understand that the singular forms "a", "an", "said", and "the" may be intended to include the plural forms as well, unless the context clearly indicates otherwise. The term "and/or" includes any and all combinations of one or more of the associated listed items.

It should be noted that all expressions using "first" and "second" in the embodiments of the present disclosure are intended to distinguish between two different entities with the same name or different parameters. It can be seen that "first" and "second" are only for convenience of expression and should not be understood as limiting the embodiments of the present disclosure, which will not be explained in detail in subsequent embodiments.

In practical applications, the inventors of the present disclosure have found that the conventional pixel circuit has a problem that the demanded quality of displayed images cannot be fully satisfied due to the hysteresis characteristic and leakage current of driving thin film transistor (DTFT), so that issues such as residue images and low contrast are caused on the display screen.

The inventors of the present disclosure analyzed prior pixel circuits. Since Low Temperature Poly-silicon (LTPS) Thin Film Transistors (TFT) have the advantages of high electron mobility, fast TFT response speed, etc., circuits composed of LTPS TFTs are commonly used in prior pixel circuits. However, the inventors of the present disclosure have found in practical applications that LTPS TFTs have the disadvantage of poor hysteresis characteristics, resulting in significant residue images in the prior pixel circuits; and LTPS TFTs have a large DTFT (driving thin film transistor) leakage current, resulting in low contrast of images produced by these pixel circuits.

The inventors of the present disclosure have recognized that, although Oxide TFTs have a better hysteresis characteristic and a small DTFT leakage current, in the case where a pixel circuit is formed of Oxide TFTs, the circuit response speed is relatively slow, and it is difficult to satisfy the high PPI (Pixels Per Inch, number of pixels per inch) requirement of the display device.

Based on the above analysis, the main idea of the present disclosure is to use an Oxide TFT as a driving transistor for driving a light emitting diode in a pixel circuit, and use LTPS TFTs for other transistors in the pixel circuit. Thus, on one hand, the Oxide TFT serves as a driving transistor for driving the light emitting diode and has advantages of a better hysteresis characteristic and a small DTFT leakage current, thereby the residue images of the light emitting diodes and the issue of low contrast can be improved. On the other hand, LTPS TFTs are used for other transistors in the pixel circuit and have the advantages of high electron mobility and fast TFT response speed. Although there is one Oxide TFT having a slow response speed in the pixel circuit, the pixel circuit still has a faster overall response speed due to the fast response of the other transistors, so that the requirement of high PPI (Pixels Per Inch) requirement of the display device can be satisfied.

In addition, considering that the prior pixel circuits generally have a function of compensating the threshold voltage of the transistor in order to solve the problem of color unevenness, and thus is not a simple driving circuit structure, the overall structure of the prior pixel circuit must be changed accordingly, rather than simply changing the driving transistor in the pixel circuit from a LTPS TFT to an Oxide TFT.

The technical solution of an embodiment of the present disclosure will be described in detail below with reference to the accompanying drawings.

Based on the above idea, FIG. 1 shows a pixel circuit for driving a light emitting diode to emit light as provided in an embodiment of the present disclosure, including: a resetting and charging circuit 101, a writing circuit 102, and a driving circuit 103.

The driving circuit 103 includes a driving transistor T3, which is an Oxide TFT, for driving a light emitting diode D1 to emit light. To drive the light emitting diode D1, the source and drain electrodes of the driving transistor T3 and the anode and cathode of the light emitting diode D1 are connected in series between a device operating voltage VDD and a common ground voltage VSS. The gate electrode of the driving transistor T3 is configured to drive the light emitting diode D1 to emit light according to a received signal. The driving circuit 103 may further include a capacitor C1 connected between the gate electrode of the driving transistor T3 in the pixel circuit and the anode of the light emitting diode D1.

The resetting and charging circuit 101 is connected to the driving circuit 103, particularly to the gate electrode of the driving transistor T3 of the driving circuit 103, and is further connected to the anode of the light emitting diode D1. The resetting and charging circuit 101 is configured to reset a capacitor C1 connected between the gate electrode of the driving transistor T3 of the pixel circuit and the anode of the light emitting diode D1, and then charge the capacitor C1. Specifically, the resetting and charging circuit 101 resets the capacitor C1 connected between the gate electrode of the driving transistor T3 and the anode of the light emitting diode D1 during a first period of time; and charges the capacitor C1 during a second period of time.

The writing circuit 102 is connected to the driving circuit 103, particularly to the gate electrode of the driving transistor T3 of the driving circuit 103. The writing circuit 102 is configured to write a data signal to the gate electrode of the driving transistor T3. Specifically, the writing circuit 102 writes a data signal to the gate electrode of the driving transistor T3 during a third period of time.

The driving circuit 103 is configured to drive the light emitting diode D1 to emit light when the driving transistor T3 receives the data signal. Specifically, the driving circuit 103 drives the light emitting diode D1 to emit light with the driving transistor during a forth period of time.

The first period of time is prior to the second period of time, the second period of time is prior to the third period of time, and the third period of time is prior to the fourth period of time.

In the pixel circuit provided in the present disclosure, the driving transistor T3 is an oxide TFT and all the other transistors are LTPS TFTs.

Figure 2:
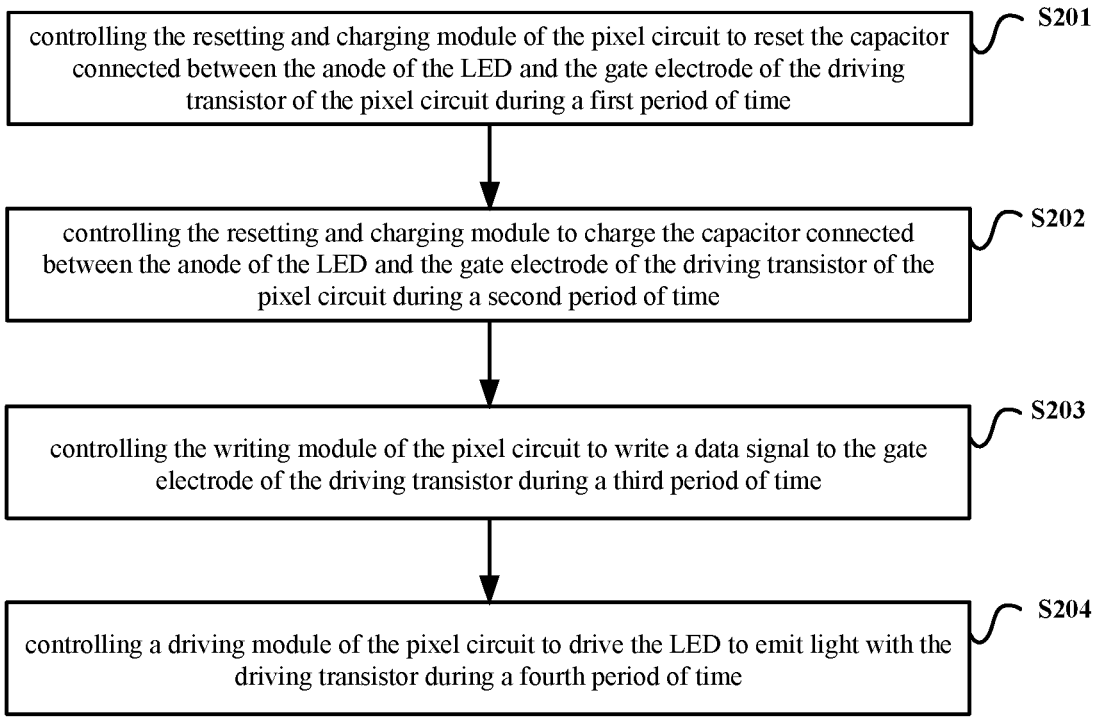
FIG. 2 is a flowchart of a method of controlling the pixel circuit according to an embodiment of the present disclosure.

FIG. 2 shows a flowchart of a method of controlling the above pixel circuit, which includes the following steps:

step S201: controlling the resetting and charging circuit 101 of the pixel circuit to reset the capacitor C1 connected between the anode of the light emitting diode D1 and the gate electrode of the driving transistor T3 of the pixel circuit during a first period of time;

step S202: controlling the resetting and charging circuit 101 to charge the capacitor C1 connected between the anode of the light emitting diode D1 and the gate electrode of the driving transistor T3 of the pixel circuit during a second period of time;

step S203: controlling the writing circuit 102 of the pixel circuit to write a data signal to the gate electrode of the driving transistor T3 during a third period of time; and step S204: controlling a driving circuit 103 of the pixel circuit to drive the light emitting diode D1 to emit light with the driving transistor T3 during a fourth period of time.

Based on the above principle, several specific example circuits are provided in the present disclosure.

Figure 3:
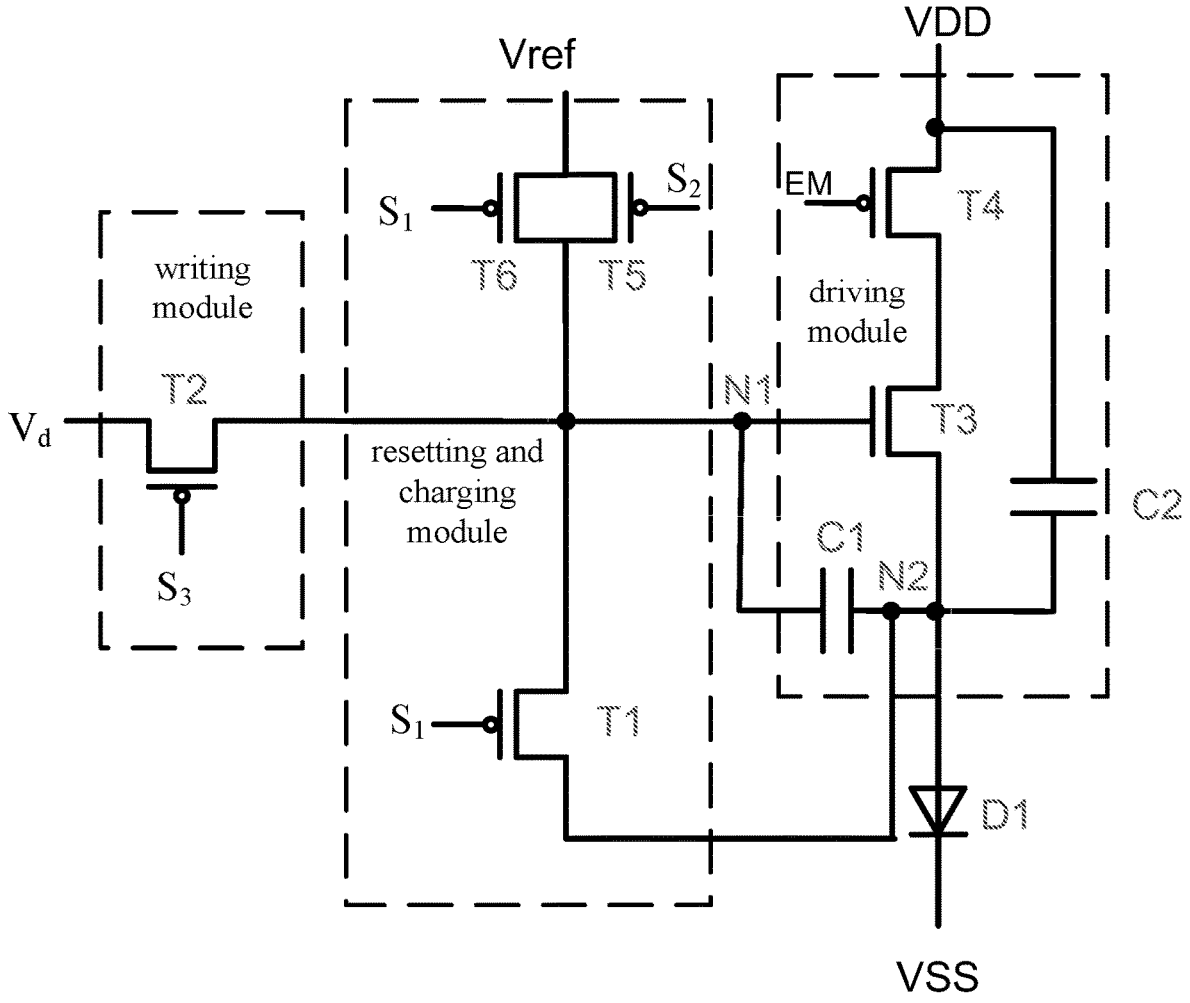
FIG. 3 is an internal structural diagram of a pixel circuit according to an embodiment of the present disclosure.

A pixel circuit provided according to an embodiment of the present disclosure is shown in FIG. 3, wherein the driving circuit is specifically configured to drive the light emitting diode D1 to emit light with the driving transistor T3 according to an active signal of a light emitting indication signal EM during the fourth period of time.

Specifically, in the pixel circuit according to an embodiment of the present disclosure, the driving circuit may include an input terminal of a light emitting indication signal. That is, the input terminal is a terminal of the pixel circuit for receiving the light emitting indication signal and is connected to a light emitting indication signal line. The driving circuit may further include: a capacitor C1, and the driving transistor T3 and the transistor T4 connected in series between the device operating voltage VDD and the anode of the light emitting diode D1. The cathode of the light emitting diode D1 is connected to the common ground voltage VSS.

For the convenience of description, the connection point of the capacitor C1 and gate electrode of the driving transistor T3 is referred as to point N1, and the connection point of the capacitor C1 and the anode of the light emitting diode D1 is referred as to point N2.

The driving circuit of the pixel circuit according to an embodiment of the present disclosure may further include a capacitor C2 connected between the device operating voltage VDD and the anode of the light emitting diode D1 to help stabilize the potential at point N2.

The writing circuit of the pixel circuit according to an embodiment of the present disclosure is specifically configured to write a data signal $V_d$ to the gate electrode of the driving transistor T3 according to an active signal of a third timing signal $S_3$ during the third period of time; wherein, the active signal of the data signal $V_d$ arrives during the third period of time.

Specifically, the writing circuit of the pixel circuit according to an embodiment of the present disclosure may include an input terminal of a third timing signal. That is, the input terminal of the third timing signal in the pixel circuit is connected to a third timing signal line (not shown).

In an embodiment according to the present disclosure, the writing circuit may further include an input terminal of a data signal $V_d$. That is, the input terminal of the data signal $V_d$ in the pixel circuit is connected to a data signal line (not shown).

In an embodiment according to the present disclosure, the writing circuit may further include a transistor T2. The gate electrode of the transistor T2 is connected to the input terminal of the third timing signal, and the source and drain electrodes of the transistor T2 are connected in series between the input terminal of the data signal $V_d$ and the gate electrode of the driving transistor T3.

The resetting and charging circuit of the pixel circuit according to an embodiment of the present disclosure is specifically configured to reset the capacitor C1 according to an active signal of a first timing signal $S_1$ arrived during the first period of time, and charge the capacitor C1 according to an active signal of a second timing signal $S_2$ arrived during the second period of time.

Specifically, the resetting and charging circuit of the pixel circuit according to an embodiment of the present disclosure may include an input terminal of a first timing signal $S_1$ and an input terminal of a second timing signal $S_2$, which are input terminals of the pixel circuit for the first timing signal and the second timing signal respectively, and are connected to a first timing signal line and a second timing signal line respectively.

The resetting and charging circuit may further include: a transistor T1, a transistor T5 and a transistor T6. The gate electrode of the transistor T5 is connected to the input terminal of the second timing signal $S_2$, and the source and the drain electrodes of the transistor T5 are connected in series between a reference voltage Vref and the gate electrode of the transistor T3. The source and drain electrodes of the transistor T1 and the source and drain electrodes of the transistor T6 are connected in series between the reference voltage Vref and the anode of the light emitting diode D1. The gate electrodes of the transistor T1 and the transistor T6 are both connected to the input terminal of the first timing signal $S_1$, and a connection point where the transistor T5 and the transistor T6 are connected is connected to the gate electrode of the transistor T3.

The input terminals of the first, second, third timing signals $S_1$, $S_2$, $S_3$ of the pixel circuit of an embodiment of the present disclosure are connected to the first, second, third timing signal lines respectively. The input terminal of the light emitting indication signal EM is connected to the light emitting indication signal line, and the input terminal of the data signal $V_d$ is connected to the data signal line. The pixel circuit is controlled to drive the light emitting diode D1 to emit light by controlling signal timings on the first, second, and third timing signal lines, the light emitting indication signal line, and the data signal line.

Figure 4:
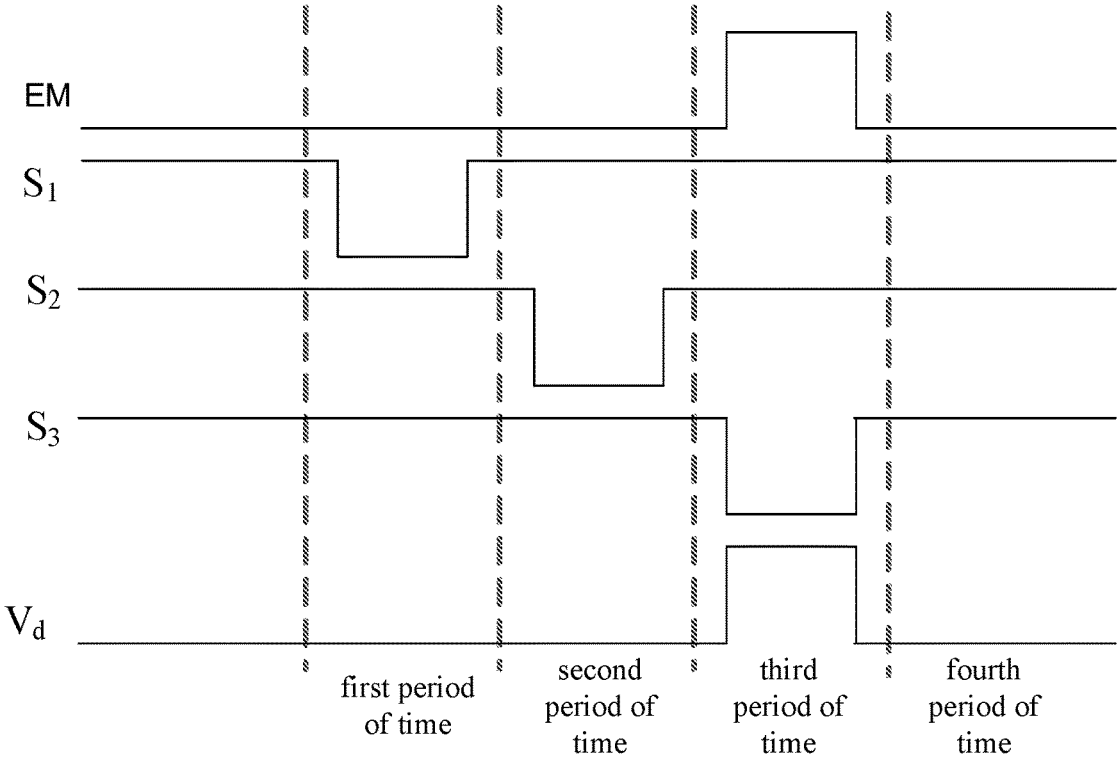
FIG. 4 is a timing diagram of various signals inputted to the pixel circuit according to an embodiment of the present disclosure.

In the pixel circuit according to an embodiment of the present disclosure, the transistor T3 is an N-type TFT, and the other transistors are P-type TFTs. Accordingly, in the technical solution according to the embodiment of the present disclosure, the active signals of the first timing signal $S_1$, second timing signal $S_2$, third timing signal $S_3$ and the light emitting indication signal EM are all low level signals, and the active signal of the data signal $V_d$ is a high level signal. The specific timings are shown in FIG. 4.

Figure 5:
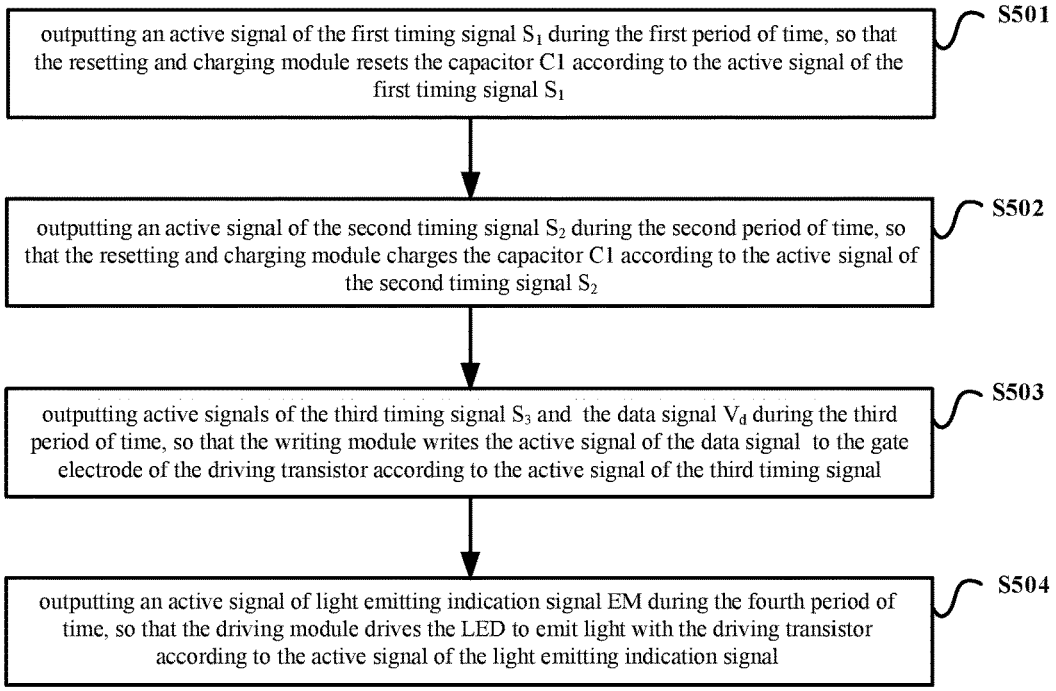
FIG. 5 is a flowchart of a method of controlling the pixel circuit according to an embodiment of the present disclosure.

FIG. 5 shows a flowchart of a method of controlling a pixel circuit according to an embodiment of the present disclosure, which includes the following steps.

Step S501: outputting an active signal of the first timing signal $S_1$ during the first period of time, so that the resetting and charging circuit resets the capacitor C1 according to the active signal of the first timing signal $S_1$.

Specifically, during the first period of time, it is controlled to output a low level signal of the first timing signal $S_1$ as the active signal of the first timing signal $S_1$, and the second timing signal $S_2$, third timing signal $S_3$ and the data signal $V_d$ are all inactive signals. At this moment, the transistors T1, T6 are turned on, the voltages at points N1 and N2 are reset, so that the capacitor C1 is reset, or the capacitors C1 and C2 are reset.

Step S502: outputting an active signal of the second timing signal $S_2$ during the second period of time, so that the resetting and charging circuit charges the capacitor C1 according to the active signal of the second timing signal $S_2$.

Specifically, during the second period of time, it is controlled to output a low level signal of the second timing signal $S_2$ as the active signal of the second timing signal $S_2$, while the first timing signal $S_1$, third timing signal $S_3$ and the data signal $V_d$ are all inactive signals. At this moment, the transistors T1, T6 are turned off, and the transistor T5 is turned on; the voltage at point N1 is Vref, the voltage at point N2 is Vref−Vth, and the capacitor C1 is charged. Vth is the threshold voltage of the driving transistor T3.

step S503: outputting active signals of the third timing signal $S_3$ and the data signal $V_d$ during the third period of time, so that the writing circuit writes the active signal of the data signal $V_d$ to the gate electrode of the driving transistor T3 according to the active signal of the third timing signal $S_3$.

Specifically, during the third period of time, it is controlled to output a low level signal of the third timing signal $S_3$ as the active signal of the third timing signal $S_3$, and to output a high level signal of the data signal $V_d$ as the active signal of the data signal $V_d$. The first timing signal $S_1$, second timing signal $S_2$ and the light emitting indication signal EM are all inactive signals. At this moment, the transistor T2 is turned on to write the high level active signal of the data signal $V_d$ to the gate electrode of the driving transistor T3; the voltage $V_{N1}$ at point N1 is equal to the high voltage level of the data signal $V_d$, the voltage value $V_{N2}$ at point N2 is calculated by the following equation:

$$V_{N2}=(Vref-Vth)+C1*\Delta V_{N1}/(C1+C2)=(Vref-Vth)+C1*(Vref-Vth)/(C1+C2) \quad \text{(equation 1)}$$

wherein, C1, C2 represent the capacitance values of capacitors C1 and C2 respectively, $\Delta V_{N1}$ represents a change in the value of the voltage $V_{N1}$ at point N1 during the third period of time.

Step S504: outputting an active signal of the light emitting indication signal EM during the fourth period of time, so that the driving circuit drives the light emitting diode D1 to emit light with the driving transistor T3 according to the active signal of the light emitting indication signal EM.

Specifically, it is controlled to output a low level signal of the light emitting indication signal EM as the active signal of the light emitting indication signal EM during the fourth period of time, and the first, second, third timing signals $S_1$, $S_2$, $S_3$ are all inactive signals. At this moment, the transistor T4 is turned on, the gate electrode of the driving transistor T3 is held at a high voltage level due to the voltage holding effect of the capacitor C1, so that the driving transistor T3 is also turned on to drive the light emitting diode D1 to emit light. At this moment, the voltage at point N2 is equal to the voltage VEL at the anode of the light emitting diode D1 when the light emitting diode D1 is turned on, and the voltage $V_{N1}$ at point N1 is calculated by equation 2:

$$V_{N1}=V\text{data}+VEL-V\text{ref}+V\text{th}-C1*(V\text{data}-V\text{ref})/(C1+C2) \quad \text{(equation 2)}$$

Figure 6:
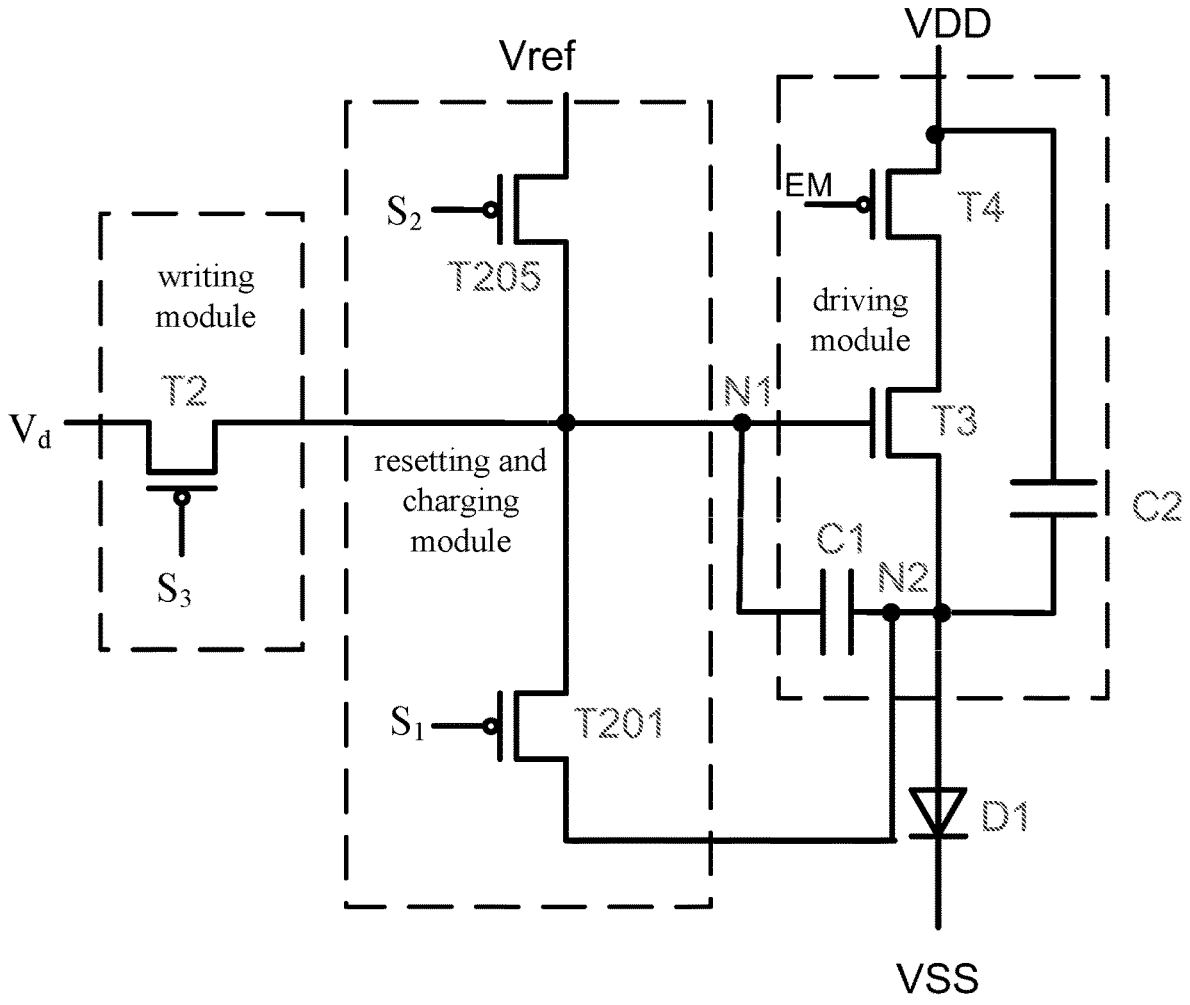
FIG. 6 is an internal structural diagram of a pixel circuit according to an embodiment of the present disclosure.

As shown in FIG. 6, the circuit structures of the driving circuit and the writing circuit of the pixel circuit according to an embodiment of the present disclosure are the same as the circuit structures of the driving circuit and the writing circuit of the pixel circuit shown in FIG. 3 respectively, which will not be repeated herein.

The resetting and charging circuit of the pixel circuit according to an embodiment of the present disclosure is specifically configured to reset the capacitor C1 according to the active signals of the first timing signal $S_1$ and the second timing signal $S_2$ that arrived during the first period of time, and to charge the capacitor C1 according to the active signal of the second timing signal $S_2$ that continues in the second period of time.

Specifically, the resetting and charging circuit of the pixel circuit provided in the embodiment of the present disclosure includes: input terminals of the first, second timing signals $S_1$ and $S_2$, configured as the terminals in the pixel circuit for inputting the first and second timing signals $S_1$ and $S_2$, and connected to a first timing signal line and a second timing signal line respectively.

The resetting and charging circuit in the pixel circuit according to an embodiment of the present disclosure may further include: a transistor T205 and a transistor T201. The source and drain electrodes of the transistor T205 and the source and drain electrodes of the transistor T201 are connected in series between the reference voltage Vref and the anode of the light emitting diode D1. The gate electrodes of the transistor T201 and the transistor T205 are connected to the input terminals of the first and second timing signals $S_1$, $S_2$ respectively, and the point where the transistor T205 and the transistor T201 are connected is connected to the gate electrode of the transistor T3.

The input terminals of the first, second, third timing signals $S_1$, $S_2$, $S_3$ of the pixel circuit according to an embodiment of the present disclosure are connected to the first, second, third timing signal lines respectively, the input terminal of the light emitting indication signal EM is connected to the light emitting indication signal line, and the input terminal of the data signal $V_d$ is connected to the data signal line. The pixel circuit is controlled to drive the light emitting diode D1 to emit light by controlling signal timings on the first, second, and third timing signal lines, the light emitting indication signal line, and the data signal line.

Figure 7:
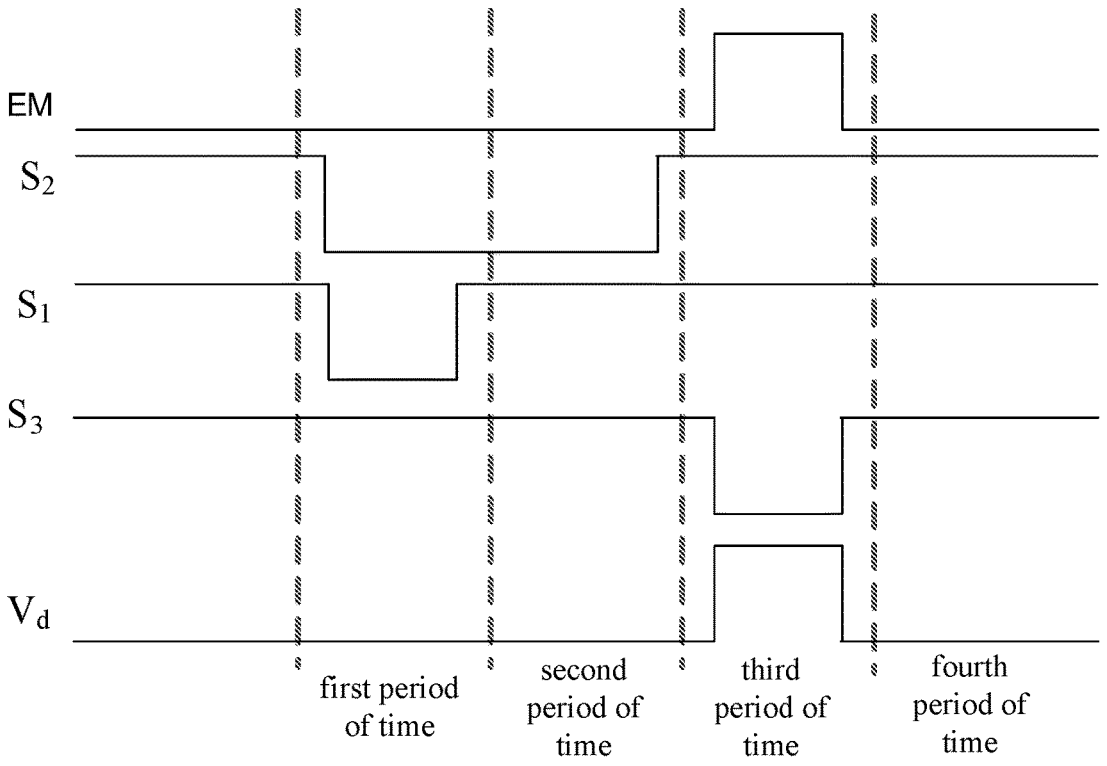
FIG. 7 is a timing diagram of various signals inputted to the pixel circuit according to an embodiment of the present disclosure.

In the pixel circuit according to an embodiment of the present disclosure, the transistor T3 is an N-type TFT, and the transistors T1, T2, T4, T205 are all P-type TFTs. Accordingly, in a technical solution according to the embodiment of the present disclosure, the active signals of the first, second, and third timing signals $S_1$, $S_2$, $S_3$, and the light emitting indication signal EM are all low level signals, and the active signal of the data signal $V_d$ is a high level signal. The specific timings are shown in FIG. 7.

Figure 8:
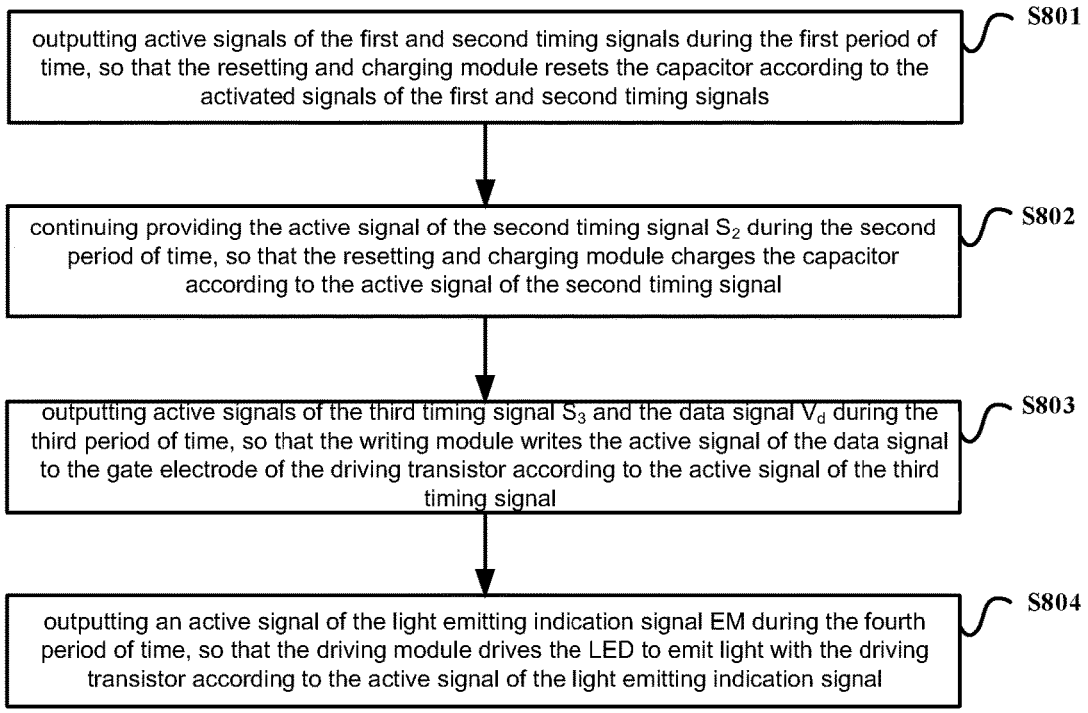
FIG. 8 is a flowchart of a method of controlling the pixel circuit according to an embodiment of the present disclosure.

FIG. 8 shows a flowchart of a method of controlling the pixel circuit according to an embodiment of the present disclosure, which includes the following steps.

Step S801: outputting active signals of the first and second timing signals $S_1$, $S_2$ during the first period of time, so that the resetting and charging circuit resets the capacitor C1 according to the active signals of the first, second timing signals $S_1$, $S_2$.

Specifically, in the first period of time, it is controlled to output a low level signal of the first timing signal $S_1$ as the effect signal of the first timing signal $S_1$, and to output a low level signal of the second timing signal $S_2$ as the active signal of the second timing signal $S_2$. Both of the third timing signal $S_3$ and the data signal $V_d$ are inactive signals. At this moment, the transistors T201, T205 are turned on, the voltages at points N1 and N2 are reset, so that the capacitor C1 is reset, or the capacitors C1 and C2 are reset. Point N1 is the point where the capacitor C1 and the gate electrode of the driving transistor T3 are connected, and point N2 is the point where the capacitor C1 and the anode of the light emitting diode D1 are connected.

Step S802: continuing providing the active signal of the second timing signal $S_2$ during the second period of time, so that the resetting and charging circuit charges the capacitor C1 according to the active signal of the second timing signal $S_2$.

Specifically, in the second period of time, it is controlled to output the second timing signal $S_2$ which continues to be a low level active signal. The first, third timing signals $S_1$, $S_3$ and the data signal $V_d$ are all inactive signals. At this moment, the transistor T201 is turned off, and the transistor T205 is turned on; the voltage at point N1 is Vref, the voltage at point N2 is Vref−Vth, and the capacitor C1 is charged.

Step S803: outputting active signals of the third timing signal $S_3$ and the data signal $V_d$ during the third period of time, so that the writing circuit writes the active signal of the data signal $V_d$ to the gate electrode of the driving transistor T3 according to the active signal of the third timing signal $S_3$.

Since the writing circuit of the embodiment according to the present disclosure in FIG. 6 is the same in circuit structure as the writing circuit according to the embodiment of the present disclosure in FIG. 3, this step is the same as step S503 in FIG. 5, and will not be repeated herein.

Step S804: outputting an active signal of the light emitting indication signal EM, so that the driving circuit drives the light emitting diode D1 to emit light with the driving transistor T3 according to the active signal of the light emitting indication signal EM.

Since the driving circuit of this embodiment according to the present disclosure in FIG. 6 is the same in circuit structure as the driving circuit according to the embodiment of the present disclosure in FIG. 3, this step is the same as step S504 in FIG. 5, and will not be repeated herein.

Figure 9:
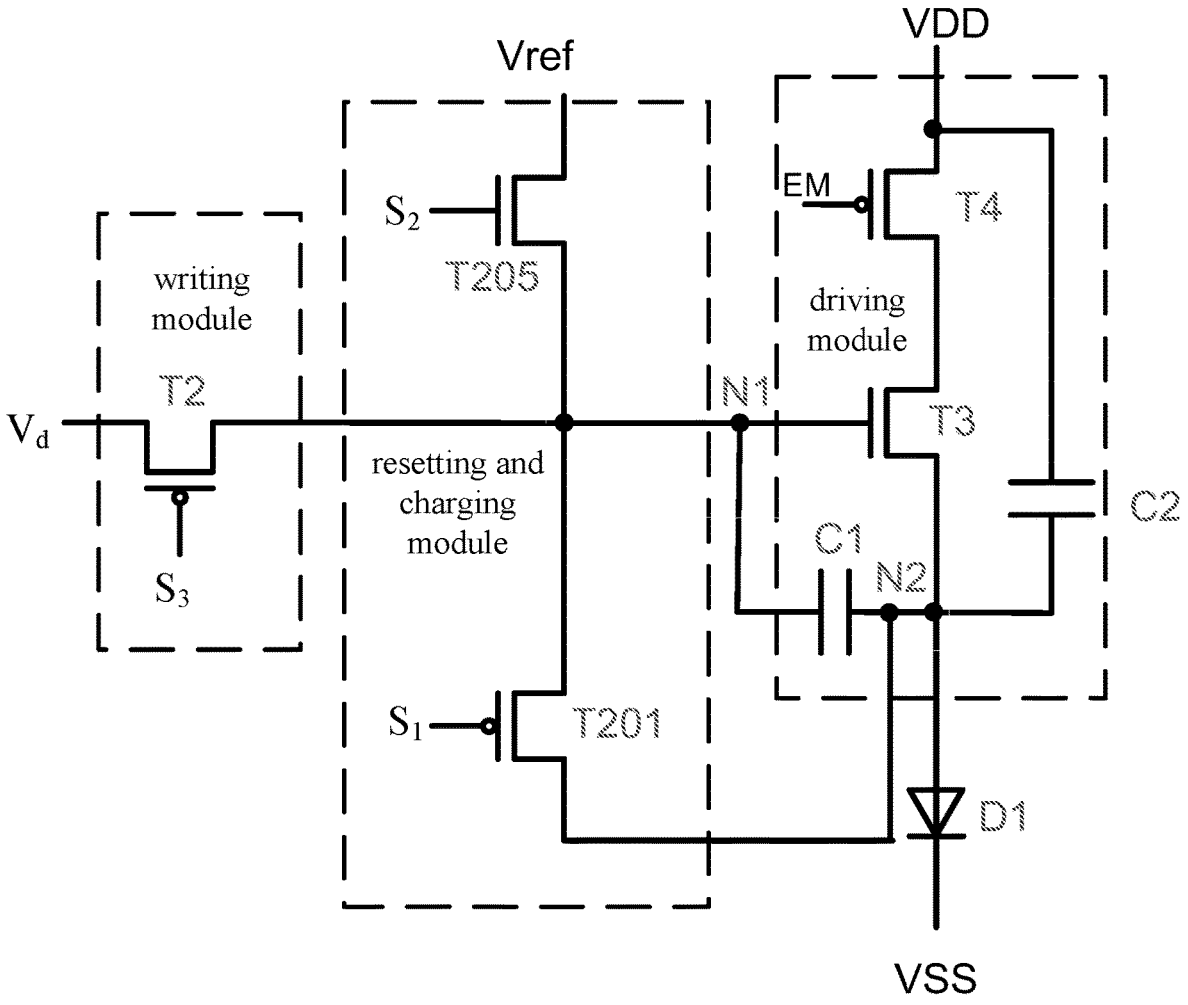
FIG. 9 is an internal structural diagram of a pixel circuit according to an embodiment of the present disclosure.

As shown in FIG. 9, the circuit structures of the driving circuit and the writing circuit of the pixel circuit according to this embodiment of the present disclosure are the same as the circuit structures of the driving circuit and the writing circuit of the pixel circuit in FIG. 3 respectively, which will not be repeated herein.

The resetting and charging circuit of the pixel circuit according to this embodiment of the present disclosure is specifically configured to reset the capacitor C1 according to active signals of the first timing signal $S_1$ and the second timing signal $S_2$ that arrive during the first period of time arrives, and charge the capacitor C1 according to the active signal of the second timing signal $S_2$ that continues in the second period of time.

Specifically, the resetting and charging circuit of the pixel circuit according to an embodiment of the present disclosure may include input terminals of the first timing signal $S_1$ and the second timing signal $S_2$, which are terminals of the pixel circuit for inputting the first timing signal $S_1$ and the second timing signal $S_2$ respectively, and are connected to a first timing signal line and a second timing signal line respectively.

The resetting and charging circuit according to an embodiment of the present disclosure may further include: a transistor T205 and a transistor T201; wherein, the source and drain electrodes of the transistor T205 and the source and drain electrodes of the transistor T201 are connected in series between the reference voltage Vref and the anode of the light emitting diode D1; the gate electrodes of the transistors T201 and T205 are connected to the input terminals of the first and second timing signals $S_1$, $S_2$ respectively, the point where the transistor T205 and the transistor T201 are connected is connected to the gate electrode of the transistor T3.

Figure 10:
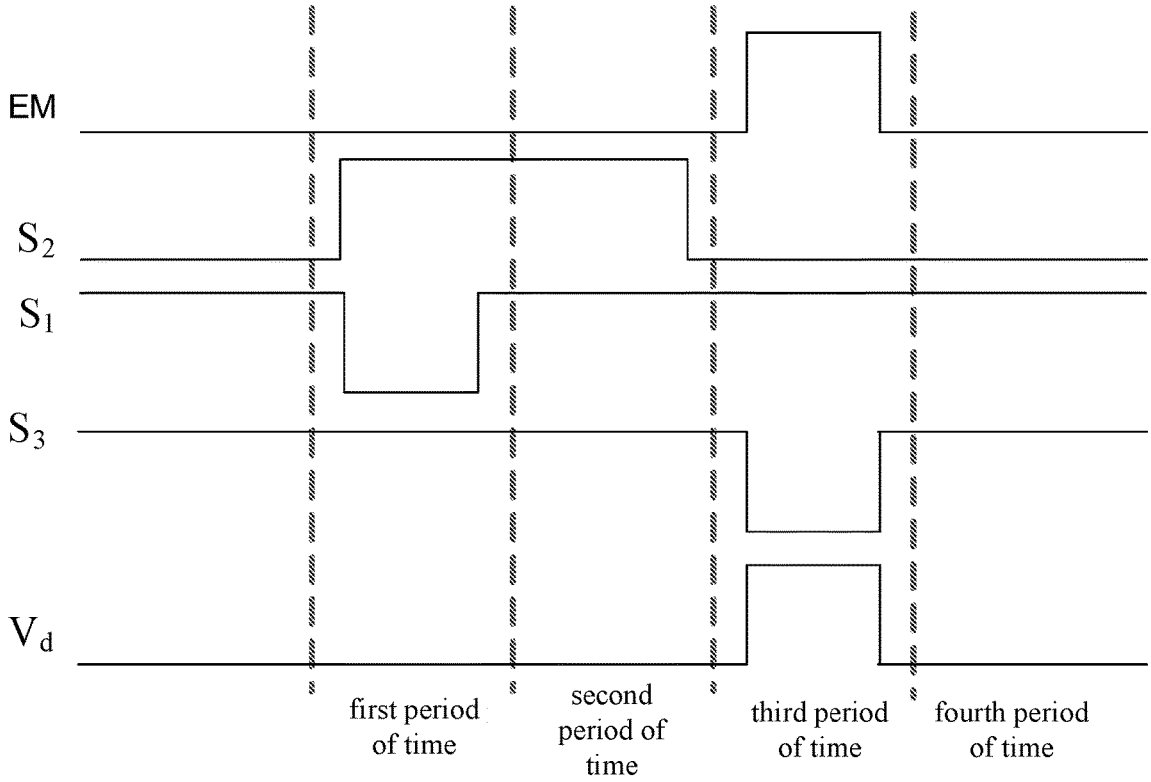
FIG. 10 is a timing diagram of various signals inputted to the pixel circuit according to an embodiment of the present disclosure.

Different from the pixel circuit shown in FIG. 6, the transistor T205 in the pixel circuit of FIG. 9 is an N-type TFT; that is, in the pixel circuit according to the embodiment of the present disclosure shown in FIG. 9, the transistors T3 and T205 are N-type TFTs, and all the other transistors T201, T2, T4 are P-type TFTs. Accordingly, in a technical solution according to an embodiment of the present disclosure, the active signals of the first, third timing signals $S_1$, $S_3$, and the light emitting indication signal EM are all low level signals, the active signal of the second timing signal $S_2$ is a high level signal, and the active signal of the data signal $V_d$ is a high level signal. The specific timings are shown in FIG. 10.

The input terminals of the first, second, third timing signals $S_1$, $S_2$, $S_3$ of the pixel circuit according to an embodiment of the present disclosure are connected to the first, second, third timing signal lines respectively, the input terminal of the light emitting indication signal EM is connected to the light emitting indication signal line, and the input terminal of the data signal $V_d$ is connected to the data signal line. The pixel circuit is controlled to drive the light emitting diode D1 to emit light by controlling signal timings on the first, second, and third timing signal lines, the light emitting indication signal line, and the data signal line.

Figure 11:
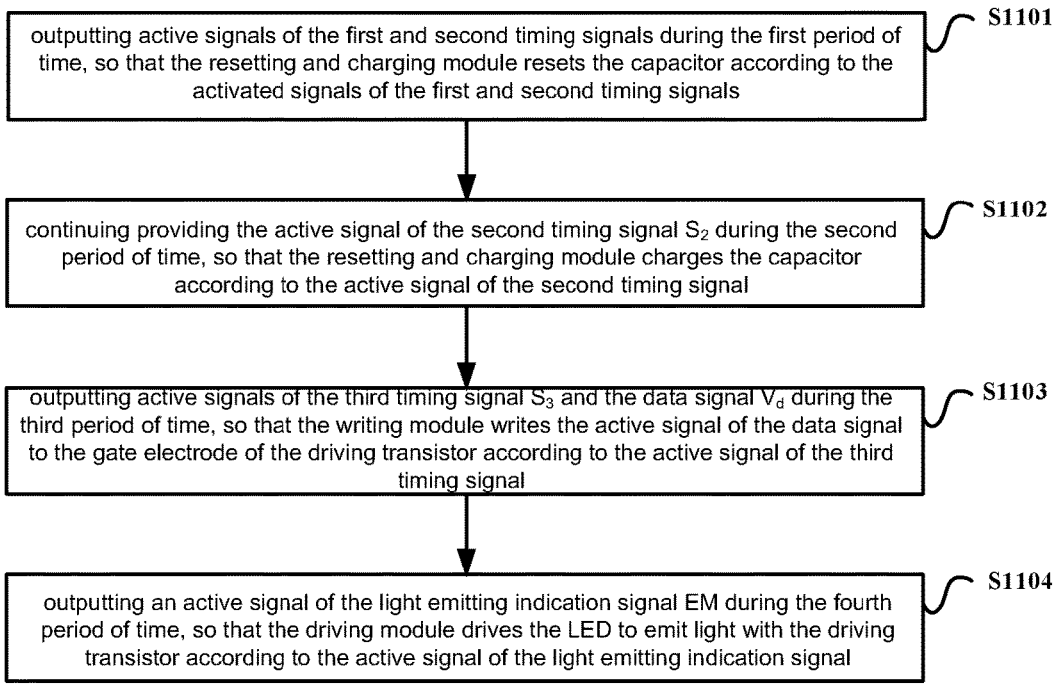
FIG. 11 is a flowchart of a method of controlling the pixel circuit according to an embodiment of the present disclosure.

FIG. 11 shows a flowchart of method of controlling a pixel circuit according to an embodiment of the present disclosure, which includes the following steps.

Step S1101: outputting active signals of the first and second timing signals $S_1$, $S_2$ during the first period of time, so that the resetting and charging circuit resets the capacitor C1 according to the active signals of the first, second timing signals $S_1$, $S_2$.

Specifically, in the first period of time, it is controlled to output a low level signal of the first timing signal $S_1$ as the active signal of the first timing signal $S_1$, and to output a high level signal of the second timing signal $S_2$ as the active signal of the second timing signal $S_2$. Both of the third timing signal $S_3$ and the data signal $V_d$ are inactive signals. At this moment, the transistors T201, T205 are turned on, the voltages at points N1 and N2 are reset, so that the capacitor C1 is reset, or the capacitors C1 and C2 are reset. Point N1 is the point where the capacitor C1 and gate electrode of the driving transistor T3 are connected, point N2 is the point where the capacitor C1 and the anode of the light emitting diode D1 are connected.

Step S1102: continuing the active signal of the second timing signal $S_2$ during the second period of time, so that the resetting and charging circuit charges the capacitor C1 according to the active signal of the second timing signal $S_2$.

Specifically, in the second period of time, it is controlled to output the second timing signal $S_2$ which continues to be the active signal of the second timing signal $S_2$, while the first, third timing signals $S_1$, $S_3$ and the data signal $V_d$ are all inactive signals. At this moment, the transistor T201 is turned off, and the transistor T205 is turned on; the voltage at point N1 is Vref, the voltage at point N2 is Vref−Vth, and the capacitor C1 is charged.

Step S1103: outputting active signals of the third timing signal $S_3$ and data signal $V_d$ during the third period of time, so that the writing circuit writes the active signal of the data signal $V_d$ to the gate electrode of the driving transistor T3 according to the active signal of the third timing signal $S_3$.

Since the writing circuit of this embodiment according to the present disclosure in FIG. 9 is the same in circuit structure as the writing circuit according to the embodiment of the present disclosure in FIG. 3, this step is the same as step S503 in FIG. 5, and will not be repeated herein.

step S1104: outputting an active signal of the light emitting indication signal EM during the fourth period of time, so that the driving circuit drives the light emitting diode D1 to emit light with the driving transistor T3 according to the active signal of the light emitting indication signal EM.

Since the driving circuit of this embodiment according to the present disclosure in FIG. 9 is the same in circuit structure as the driving circuit according to the embodiment of the present disclosure in FIG. 3, this step is the same as step S504 in FIG. 5, and will not be repeated herein.

The reference voltage Vref, the device operating voltage VDD, and the common ground voltage VSS described in the above embodiments are respectively supplied from a reference voltage line, a device operating voltage line, and a common ground voltage line.

The pixel circuit according to the embodiments of the present disclosure shown in FIGS. 6 and 9 reduces a transistor compared to the pixel circuit according to the embodiment of the present disclosure shown in FIG. 3, thereby reducing the cost and the circuit area, which is advantageous for improving circuit integration.

In the technical solution according to the embodiments of the present disclosure, an Oxide TFT is employed as the driving transistor T3 for driving the light emitting diode D1 in the pixel circuit, and other transistors in the pixel circuit are LTPS TFTs. Thus, on one hand, the Oxide TFT serving as a driving transistor T3 for driving the light emitting diode D1 has advantages of a better hysteresis characteristic and a small DTFT leakage current, thereby the residue image of the light emitting diode D1 and the issue of low contrast can be improved. On the other hand, LTPS TFTs are used for other transistors in the pixel circuit, which have the advantages of high electron mobility and fast TFT response speed. Although there is one Oxide TFT having a slower response speed in the pixel circuit, the pixel circuit still has a faster overall response speed due to the fast response of the other transistors, so that the requirement of high PPI of the display device can be satisfied.

Those skilled in the art should understand that the steps, measures, solutions in the various operations, methods, and flowcharts discussed in the present disclosure may be alternated, modified, combined, or deleted. Further, other the steps, measures, solutions in the various operations, methods, and flowcharts discussed in the present disclosure may be alternated, modified, combined, or broken down, combined, or deleted. Further, in the prior art, other the steps, measures, solutions in the various operations, methods, and flowcharts discussed in the present disclosure may be alternated, modified, combined, or broken down, combined, or deleted.

It should be understood by those of ordinary skill in the art that the discussion of any of the above embodiments is merely exemplary and is not intended to suggest that the scope of the disclosure (including the claims) is limited to these examples; combinations of the technical features in the above embodiments or different embodiments can also be combined, the steps can be carried out in any order, and there are many other variations of the various aspects of the present disclosure as described above, which are not provided in detail for the sake of brevity. Within spirit and principles of this invention, any omissions, modifications, equivalent replacements, improvements etc. shall be contained in the protection scope of this invention.

What is claimed is:

1. A pixel circuit for driving a light emitting diode (LED) to emit light, including:

a resetting and charging circuit, configured to reset a capacitor connected between a gate electrode of a driving transistor of the pixel circuit and an anode of the LED, and to charge the capacitor;

a writing circuit, configured to write a data signal to the gate electrode of the driving transistor; and a driving circuit including the driving transistor and configured to drive the LED to emit light according to the data signal received from the gate electrode of the driving transistor;

wherein, the driving transistor is an oxide thin film transistor (TFT), and other transistors in the pixel circuit are low temperature polysilicon (LTPS) TFTs, wherein the driving circuit further includes: an input terminal of a light emitting indication signal, the capacitor, the driving transistor and a fourth transistor connected in series between a device operating voltage VDD and the anode of the LED, wherein, a gate electrode of the fourth transistor is connected to the input terminal of the light emitting indication signal, and the gate electrode of the driving transistor is configured to receive the data signal sent by the writing circuit, wherein the capacitor connected between the gate electrode of the driving transistor of the pixel circuit and the anode of the LED is a first capacitor, and wherein the driving circuit further includes a second capacitor connected between the device operating voltage VDD and the anode of the LED, and wherein one end of the second capacitor is directly connected to the device operating voltage VDD, and the other end of the second capacitor is directly connected to the anode of the LED.

2. The pixel circuit according to claim 1, wherein the writing circuit includes: an input terminal of a third timing signal, an input terminal of the data signal, and a second transistor, wherein, a gate electrode of the second transistor is connected to the input terminal of the third timing signal, and a source electrode and a drain electrode of the second transistor are connected in series between the input terminal of the data signal and the gate electrode of the driving transistor.

3. The pixel circuit according to claim 2, wherein the resetting and charging circuit includes: an input terminal of a first timing signal, an input terminal of a second timing signal, a fifth transistor and a first transistor, wherein, source and drain electrodes of the fifth transistor and source and drain electrodes of the first transistor are connected in series between a reference voltage and the anode of the LED; gate electrodes of the first transistor and the fifth transistor are respectively connected to the input terminals of the first and second timing signals, a point where the fifth transistor and the first transistor are connected is connected to the gate electrode of the driving transistor.

4. The pixel circuit according to claim 3, wherein the first transistor, the second transistor, the fourth transistor are all P-type TFTs, and the fifth transistor is an N-type TFT; and active signals of the first and the third timing signals and the light emitting indication signal are all low level signals, and an active signal of the second timing signal is a high level signal.

5. A display device, including: the pixel structure according to claim 1.

6. A pixel circuit for driving a light emitting diode (LED) to emit light, including:

a resetting and charging circuit, configured to reset a capacitor connected between a gate electrode of a driving transistor of the pixel circuit and an anode of the LED, and to charge the capacitor;

a writing circuit, configured to write a data signal to the gate electrode of the driving transistor; and a driving circuit including the driving transistor and configured to drive the LED to emit light according to the data signal received from the gate electrode of the driving transistor;

wherein, the driving transistor is an oxide thin film transistor (TFT), and other transistors in the pixel circuit are low temperature polysilicon (LTPS) TFTs, wherein the driving circuit further includes: an input terminal of a light emitting indication signal, the capacitor, the driving transistor and a fourth transistor connected in series between a device operating voltage VDD and the anode of the LED, wherein a gate electrode of the fourth transistor is connected to the input terminal of the light emitting indication signal, and the gate electrode of the driving transistor is configured to receive the data signal sent by the writing circuit, the writing circuit includes: an input terminal of a third timing signal, an input terminal of the data signal, and a second transistor, wherein, a gate electrode of the second transistor is connected to the input terminal of the third timing signal, and a source electrode and a drain electrode of the second transistor are connected in series between the input terminal of the data signal and the gate electrode of the driving transistor, wherein the resetting and charging circuit includes: an input terminal of a first timing signal, an input terminal of a second timing signal, a first transistor, a fifth transistor, and a sixth transistor, wherein, a gate electrode of the fifth transistor is connected to the input terminal of the second timing signal, and a source and drain electrodes of the fifth transistor are connected in series between a reference voltage and the gate electrode of the driving transistor; a source and drain electrodes of the first transistor and a source and drain electrodes of the sixth transistor are connected in series between the reference voltage and the anode of the LED; gate electrodes of the first transistor and the sixth transistor are both connected to the input terminal of the first timing signal, and a point where the fifth transistor and the sixth transistor are connected is connected to the gate electrode of the driving transistor.

7. The pixel circuit according to claim 6, wherein the first transistor, the second transistor, the fourth transistor, the fifth transistor are all P-type TFTs; and active signals of the first timing signal, the second timing signal, the third timing signal and the light emitting indication signal are all low level signals.

8. A method of controlling a pixel circuit, comprising:

controlling a resetting and charging circuit of the pixel circuit to reset a capacitor connected between an anode of a light emitting diode (LED) and a gate electrode of a driving transistor of the pixel circuit during a first period of time;

controlling the resetting and charging circuit to charge the capacitor during a second period of time;

controlling a writing circuit of the pixel circuit to write a data signal to the gate electrode of the driving transistor during a third period of time; and controlling a driving circuit of the pixel circuit to drive the LED to emit light with the driving transistor during a fourth period of time, wherein, the driving transistor is an oxide thin film transistor (TFT), and other transistors in the pixel circuit are all low temperature polysilicon (LTPS) TFTs, wherein controlling the driving circuit of the pixel circuit to drive the LED to emit light with the driving transistor during the fourth period of time comprises:

outputting an active signal of a light emitting indication signal during the fourth period of time, so that the driving circuit drives the LED to emit light with the driving transistor according to the active signal of the light emitting indication signal, wherein the driving circuit specifically includes: the capacitor, and the driving transistor and a fourth transistor connected in series between a device operating voltage VDD and an anode of the LED, wherein a gate electrode of the fourth transistor is connected to an input terminal of the light emitting indication signal, and a gate electrode of the driving transistor is configured to receive the data signal sent by the writing circuit, wherein the capacitor connected between the gate electrode of the driving transistor of the pixel circuit and the anode of the LED is a first capacitor, and wherein the driving circuit further includes a second capacitor connected between the device operating voltage VDD and the anode of the LED, and wherein the driving circuit further includes a second capacitor connected between the device operating voltage VDD and the anode of the LED, and wherein one end of the second capacitor is directly connected to the device operating voltage VDD, and the other end of the second capacitor is directly connected to the anode of the LED.

9. The method according to claim 8, wherein controlling a writing circuit of the pixel circuit to write a data signal to the gate electrode of the driving transistor during the third period of time includes:

outputting active signals of a third timing signal and the data signal during the third period of time, so that the writing circuit writes the active signal of the data signal to the gate electrode of the driving transistor according to the active signal of the third timing signal, wherein the writing circuit includes: a second transistor, a gate electrode of the second transistor connected to an input terminal of the third timing signal, and source and drain electrodes of the second transistor connected in series between an input terminal of the data signal and the gate electrode of the driving transistor.

10. The method according to claim 9, wherein controlling the resetting and charging circuit of the pixel circuit to reset a capacitor connected between the anode of the LED and the gate electrode of the driving transistor (T3) of the pixel circuit during a first period of time, and controlling the resetting and charging circuit to charge the capacitor during a second period of time comprises:

outputting an active signal of a first timing signal during the first period of time, so that the resetting and charging circuit resets the capacitor according to the active signal of the first timing signal; and outputting an active signal of a second timing signal during the second period of time, so that the resetting and charging circuit charges the capacitor according to the active signal of the second timing signal;

wherein the resetting and charging circuit includes a first transistor, a fifth transistor and a sixth transistor;

wherein, a gate electrode of the fifth transistor is connected to an input terminal of the second timing signal, and source and drain electrodes of the fifth transistor are connected in series between an input terminal of a reference voltage and the gate electrode of the driving transistor; source and drain electrodes of the first transistor and source and drain electrodes of the sixth transistor are connected in series between the input terminal of the reference voltage and the anode of the LED; gate electrodes of the first transistor and the sixth transistor are both connected to an input terminal of the first timing signal, and a point where the fifth transistor and the sixth transistor are connected is connected to the gate electrode of the driving transistor.

11. The method according to claim 9, wherein controlling the resetting and charging circuit of the pixel circuit to reset a capacitor connected between the anode of the LED and the gate electrode of the driving transistor of the pixel circuit during a first period of time, and controlling the resetting and charging circuit to charge the capacitor during a second period of time comprises:

outputting an active signal of a first timing signal and an active signal of a second timing signal during the first period of time, so that the resetting and charging circuit resets the capacitor according to the active signals of the first and second timing signals;

continuing providing the active signal of the second timing signal during the second period of time, so that the resetting and charging circuit charges the capacitor according to the active signal of the second timing signal, wherein the resetting and charging circuit includes: a fifth transistor and a first transistor, wherein, source and drain electrodes of the fifth transistor and source and drain electrodes of the first transistor are connected in series between an input terminal of a reference voltage and the anode of the LED; gate electrodes of the first transistor and the fifth transistor are respectively connected to input terminals of the first and second timing signals, and a point where the fifth transistor and the first transistor are connected is connected to the gate electrode of the driving transistor.

12. The method according to claim 11, wherein the active signals of the first, second, and third timing signals and the light emitting indication signal are all low level signals, and the first transistor, the second transistor, the fourth transistor, the fifth transistor are all P-type TFTs; or active signals of the first and the third timing signals and the light emitting indication signal are all low level signals; the active signal of the second timing signal is a high level signal, and the first transistor, the second transistor, the fourth transistor are all P-type TFTs, and the fifth transistor is an N-type TFT.

* * * * *